United States Patent [19]

Lanier

[11] 4,288,471

[45] Sep. 8, 1981

[54] CABLE END SEALING METHOD

[75] Inventor: Jerry W. Lanier, Carrollton, Ga.

[73] Assignee: Southwire Company, Carrollton, Ga.

[21] Appl. No.: 146,887

[22] Filed: May 5, 1980

[51] Int. Cl.[3] ..... B05D 3/00; B05D 5/00; B05D 7/20

[52] U.S. Cl. ..... 427/120; 427/117; 427/156; 427/287; 427/299; 174/74 A; 174/77 R

[58] Field of Search ..... 427/117, 120, 156, 287, 427/299; 174/74 A, 74 R, 76, 77 R, 110 PM

[56] References Cited

U.S. PATENT DOCUMENTS

| | | | |
|---|---|---|---|
| 3,324,441 | 6/1967 | Olsen et al. | 174/76 X |
| 3,522,121 | 7/1970 | Lovelock et al. | 174/77 R |
| 3,971,884 | 7/1976 | Meeks et al. | 427/120 X |
| 4,025,717 | 5/1977 | Whittingham | 174/76 X |
| 4,152,538 | 5/1979 | Gassinger et al. | 174/76 X |

FOREIGN PATENT DOCUMENTS

| | | | |
|---|---|---|---|
| 2509474 | 9/1976 | Fed. Rep. of Germany | 174/74 A |
| 2525964 | 12/1977 | Fed. Rep. of Germany | 174/74 A |

*Primary Examiner*—Shrive P. Beck

*Attorney, Agent, or Firm*—Herbert M. Hanegan; Stanley L. Tate; Frank A. Peacock

[57] ABSTRACT

Disclosed is a method of sealing the ends of electrical cable to prevent ingress of contaminants such as moisture.

13 Claims, 5 Drawing Figures

CABLE END SEALING METHOD

BACKGROUND OF THE INVENTION

The present invention relates generally to cable making, and specifically to a method for sealing the ends of electrical cable.

In the continuous production of electrical cable, spools and other cable collection devices reach maximum capacity necessitating severance of the cable resulting in exposed conductors at each end. During further processing and storage, if these ends remain exposed, the entire length of cable is subject to deterioration due to ingress of contaminants such as moisture. For this reason, cable proceducers have developed numerous methods of sealing the cable ends including the use of tape, wax dip, plastisol dip, pressure caps, heat shrinking materials and other methods listed in subclass 77 of U.S. Pat. class 174.

These prior methods have been relatively cumbersome, time consuming, expensive and ineffective. One particularly aggravating problem with prior art systems is their inability to seal the cable end nearest the core of the spool because that cable end is often not readily accessible. One apparent alternative method of sealing the cable end nearest the spool core is to seal it before the cable is collected on the spool, but this is impossible because both cable ends must be exposed after collection on a spool in order to test the length of cable.

SUMMARY OF THE INVENTION

The present invention which solves these problems is a method of sealing cable ends with hot-melt adhesive applied by a portable means for melting a thermoplastic sealant and applying the molten sealant to the uncovered ends of a cable against penetration by contaminants and moisture.

Thus a major object of this invention is to provide a method for sealing the ends of electrical cables.

Another object of the present invention is to provide a dynamic system for sealing elelctric cable ends which can be used to seal ends of electric cable which have previously been inaccessible to prior art apparatus.

Still another object of this invention is to provide an economical system in terms of labor and materials for applying high quality permanent seals to electrical cable ends.

Yet another object of this invention is to provide a method of sealing the ends of an insulated electrical conductor against penetration by moisture and other contaminants comprising the steps of passing granules of thermoplastic adhesive from a remote reservoir to a means for melting the granules and applying molten thermoplastic adhesive to the open ends of an insulated electrical conductor in a manner whereby said adhesive bonds to the insulated surface of the insulated conductor and seals the open ends of the conductor against penetration by moisture and other contaminants.

BRIEF DESCRIPTION OF THE DRAWINGS

While the specification concludes with claims particularly pointing out and distinctly claiming the subject matter which is regarded as the invention, it is believed that the invention, objects, features and advantages thereof will be better understood from the following description taken in connection with the accompanied drawings in which like parts are given like identification numerals and wherein:

DESCRIPTION OF THE PREFERRED EMBODIMENT

Figure 1:
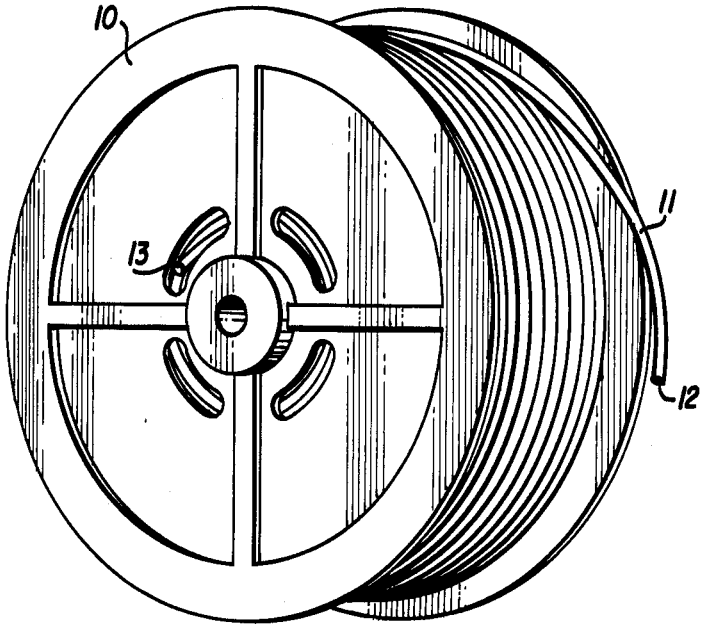
FIG. 1 illustrates an electrical cable spool with a collection of cable including easily accessible outer cable end and the not readily accessible cable end near the spool core.

As FIG. 1 illustrates, a spool 10 of electrical cable 11 has a free cable end 12 and a constrained cable end 13. To prevent deterioration of the cable 11, the cable ends 12 and 13 should be sealed.

Figure 2:
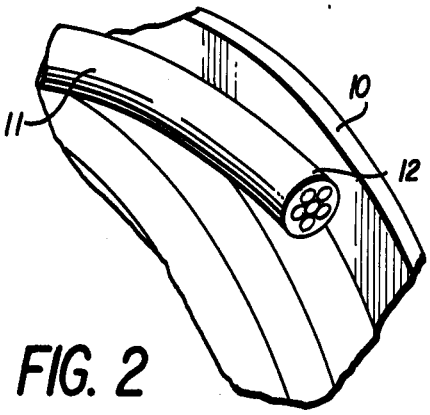
FIG. 2 is a larger view of the outer cable end.
Figure 3:
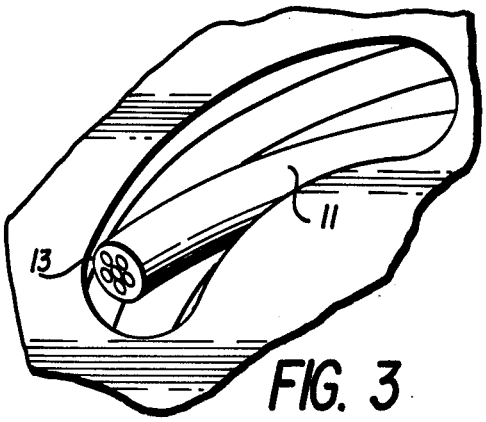
FIG. 3 is a larger view of the inner cable end.

The free cable end 12 of FIG. 2 is readily accessible, and can often be sealed without difficulty with most prior art sealing systems. The constrained cable end 13 of FIG. 3 is not readily accessible and can be sealed by prior art sealing systems only with great difficulty if at all.

Figure 4:
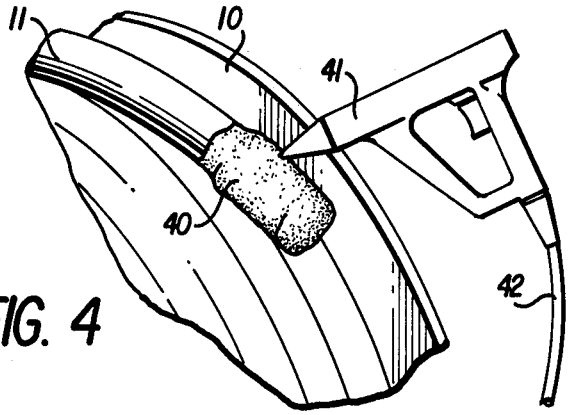
FIG. 4 illustrates application of hot-melt adhesive to the outer cable end.
Figure 5:
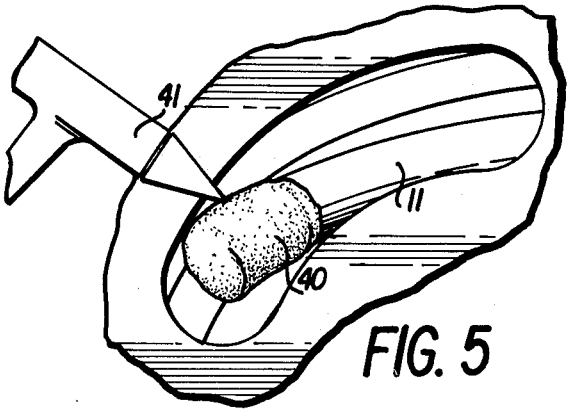
FIG. 5 illustrates application of hot-melt adhesive to the inner cable end.

The present invention is a method of sealing cable ends 12 and 13 with thermoplastic adhesive 40 (FIG. 4 and FIG. 5) applied by a conventional portable glue gun 41 (FIG. 4 and FIG. 5). As FIG. 4 and FIG. 5 illustrate, the sealing of the cable ends 12 of FIG. 2 and 13 of FIG. 3 is done without the necessity of transporting the cable ends 12 and 13 to a sealing apparatus. The glue gun 41 seals the cable ends 12 and 13 quickly and conveniently with only slight manipulation of the cable ends 12 and 13. The adhesive 40 is supplied to the glue gun 41, which melts granules of thermoplastic adhesive to provide a supply of molten adhesive, from a remote reservoir (not shown).

In a preferred embodiment of the present invention, the thermoplastic adhesive 40 is ethylene vinyl acetate polymer having a melt temperature range of from about 300° F. to about 375° F., preferrably about 350° F., a viscosity at 375° F., of about 1800 cps max., and a specific gravity at 75° F. of from about 0.95 to about 0.99. The thermoplastic adhesive 40 must develop a permanent bond when applied to polyethylene, cross-linked polyethylene polyvinyl chloride or other cable coverings. Two appropriate hot-melt adhesives 40 are Amsco-melt 319, a product of Union Chemicals Division of Union Oil Company of California; and Cascomelt HA-6287, a product of Borden Chemical Division of Borden Inc.

When the thermoplastic adhesive 40 is applied, the cable ends 12 or 13 should be dry and free of foreign matter such as dirt and grease. The adhesive applicator 41 is used to apply a coating of thermoplastic adhesive 40 to the readily accessible cable end 12 and to not readily accessible cable end 13. The minimum thickness of the adhesive 40 over the cable end should be about 0.05 inch, and the adhesive 40 should overlap onto the outer jacket of the cable 11 a minimum of 0.5 inch. If the cable 11 is a multi-conductor cable, each conductor should be sealed separately.

While this invention has been described in detail with particular reference to a preferred embodiment thereof, it will be understood that variations and modifications can be effective within the spirit and scope of the invention as described herein before and as defined in the appended claims.

I claim:

1. The method of sealing the ends of an insulated electrical conductor against penetration by moisture and other contaminants comprising the steps of passing solid thermoplastic adhesive from a remote reservoir to a means for melting said adhesive and applying molten thermoplastic adhesive to the open ends of an insulated electrical conductor in a manner whereby said adhesive bonds to the insulated surface of said insulated conductor and seals the open ends of said conductor against penetration by moisture and other contaminants, wherein said thermoplastic adhesive comprises an ethylene vinyl acetate polymer characterized by:

a melt temperature range of from about 300° F. to about 375° F.;

a viscosity of about 1800 cps at 375° F.; and a specific gravity of about 0.95 to about 0.99 at 75° F.

2. The method of claim 1 wherein said thermoplastic adhesive is applied to not readily accessible ends of constrained cable stored on a spool.

3. The method of claim 1 wherein said application of thermoplastic adhesive further comprises:

removal of contaminants from said cable ends;

application of a coating of said adhesive no less than 0.05 inch thick; and overlapping of said coating onto the outer jacket of said cable no less than 0.5 inch.

4. The method of claim 3 further comprising separately sealing each individual conductor of a multi-conductor cable.

5. The method of claim 1 wherein said solid thermoplastic adhesive is in granulated form.

6. The method of sealing the ends of an insulated electrical conductor against penetration by moisture and other contaminants comprising the steps of passing solid ethylene vinyl acetate polymer thermoplastic adhesive from a remote reservoir to means for melting said adhesive and applying molten ethylene vinyl acetate polymer thermoplastic adhesive to the open ends of an insulated electrical conductor in a manner whereby said adhesive bonds to the insulated surface of said insulated conductor and seals the open ends of said conductor against penetration by moisture and other contaminants.

7. The method of claim 6 wherein said ethylene vinyl acetate polymer thermoplastic adhesive is characterized by a melt temperature range of from about 300° F. to about 375° F.

8. The method of claim 6 wherein said ethylene vinyl acetate polymer thermoplastic adhesive is characterized by a viscosity of about 1800 cps at 375° F.

9. The method of claim 6 wherein said ethylene vinyl acetate polymer thermoplastic adhesive is characterized by a specific gravity of about 0.95 to about 0.99 at 75° F.

10. The method of claim 6 wherein said ethylene vinyl acetate polymer thermoplastic adhesive is applied to not readily accessible ends of constrained cable.

11. The method of claim 6 wherein said application of ethylene vinyl acetate polymer thermoplastic adhesive further comprises:

removal of contaminants from said cable ends;

application of a coating of said adhesive no less than 0.05 inch thick; and overlapping of said coating onto said outer jacket of said cable no less than 0.5 inch.

12. The method of claim 11 further comprising separately sealing each individual conductor of a multi-conductor cable.

13. The method of claim 6 wherein said solid ethylene vinyl acetate polymer thermoplastic adhesive is in granulated form.

* * * * *